United States Patent [19]

Olsson

[11] Patent Number: 4,752,231

[45] Date of Patent: Jun. 21, 1988

[54] ELECTRICAL CONNECTOR FOR USE BETWEEN SPACED APART CIRCUIT BOARDS

[75] Inventor: Billy E. Olsson, New Cumberland, Pa.

[73] Assignee: General Patent Counsel/AMP Inc., Harrisburg, Pa.

[21] Appl. No.: 899,585

[22] Filed: Aug. 25, 1986

[51] Int. Cl.[4] ..... H01R 9/09

[52] U.S. Cl. ..... 439/66

[58] Field of Search ..... 339/17 M, 17 LM, 17 CF, 339/176 M, 176 MP; 324/158 P, 158 F; 439/66–74

[56] References Cited

U.S. PATENT DOCUMENTS

| | | | |
|---|---|---|---|
| 2,965,811 | 12/1960 | Batcher | 339/18 C |
| 3,795,037 | 3/1974 | Luttmer | 339/59 M |
| 4,161,346 | 7/1979 | Cherian | 339/17 M |
| 4,351,580 | 9/1982 | Kirkman et al. | 339/17 CF |
| 4,634,199 | 1/1987 | Anhalt et al. | 339/17 M |

OTHER PUBLICATIONS

IBM Bulletin, Faure, vol. 17, No. 2, p. 444, 7–1974.

*Primary Examiner*—Neil Abrams

*Attorney, Agent, or Firm*—Bruce J. Wolstoncroft

[57] ABSTRACT

Electrical connector intended for use between spaced-apart parallel circuit boards comprises a rigid insulating housing having oppositely facing connector mating surfaces which are opposed to the surfaces of the circuit boards. Sheet metal conductors are contained in the housing assembly, each conductor having end portions which extend beyond the connector mating surfaces. Each conductor has an intermediate spring portion which is within the housing assembly so that the end portions of the conductors can be moved recessively into the housing with accompanying flexure of the spring. In use, the connector is clamped between the opposed surfaces of the circuit boards with the end portions of the conductors opposed to terminal pads on the circuit board surfaces. The spring portions of the conductors are flexed so that the end portions are urged against, and into, the terminal pads thereby to establish electrical contact. The connector is particularly intended for use under circumstances where the terminal pads are plated with tin-lead alloy.

15 Claims, 4 Drawing Sheets

ELECTRICAL CONNECTOR FOR USE BETWEEN SPACED APART CIRCUIT BOARDS

FIELD OF THE INVENTION

This invention relates to electrical connectors of the type which are intended for use between the opposed surfaces of parallel spaced-apart circuit boards or the like.

BACKGROUND OF THE INVENTION

U.S. Pat. Nos. 3,795,037, 4,593,961, and 4,509,099 show electrical connectors of a type which in general comprise an elastomeric body having conductors extending through the body for engagement with terminal areas or pads on the opposed surfaces of parallel spaced-apart substrates such as circuit boards. When the substrates are clamped to each other with the connector sandwiched between the opposed surfaces and with the conductors in the connector in alignment with opposed terminal pads, the terminal pads on the two surfaces are selectively connected to each other. There is frequently a need for connectors of this type for connecting opposed terminal pads or other electrodes on opposed surfaces, and this need has been met in the past by elastomeric type connecting devices.

There are circumstances where the elastomeric type, however, is not suitable for connecting opposed electrodes on parallel opposed surfaces, for example, where a relatively high contact force is required, and/or the particular advantages of elastomeric connectors are not required. In general, elastomeric connectors do not achieve a relatively high contact force and they are usually employed where the contact pads on the substrates are gold plated as in microelectronic devices. If the electrodes, such as the terminal pads, are plated with a lead-tin alloy rather than with gold, a significantly higher contact force is required than the force which can be achieved ordinarily with elastomeric type connectors. The present invention is directed to the achievement of a connector intended for use between parallel circuit boards having conductors extending through the connector body with each conductor having an integral spring that is capable of producing a high contact force if desired.

THE INVENTION

In accordance with one embodiment thereof, the invention comprises an electrical connector for connecting a first group of electrodes on a first panel surface to a second group of electrodes on a second panel surface, the first and second panel surfaces being opposed to each other and being on parallel spaced-apart panel-like members such as circuit boards. The electrodes in the first group are arranged in a row on the first panel surface and the electrodes in the second group are arranged in a row on the second panel surface, the rows and the individual electrodes being in aligned relationship. The connector comprises a connector body having oppositely facing first and second mating surfaces and having conductors extending through the body and between the mating surfaces. The connector is particularly characterized in that each of the conductors has a first end portion and a second end portion, the first end portion being proximate to, and extending beyond, the first connector mating surface. The second end portion is proximate to, and extends beyond, the second connector mating surface. Each of the conductors has an intermediate resiliently deformable spring portion and at least one of the end portions is recessively movable towards, and into, its associated connector mating surface with accompanying resilient deformation of the spring portion. The connector body comprises a rigid insulating housing assembly having side-by-side spaced-apart cavities therein which are between the first and second mating surfaces. The spring portions of the conductors are contained in the cavities so that upon placement of the connector body between the first and second panel-like members and clamping the connector body between the surfaces, the end portion of the conductors will engage the electrodes on the surfaces.

In accordance with further embodiments, the electrodes are terminal pads on the first and second surfaces and the conductors are stamped and formed sheet metal members, the intermediate spring portions being in the form of semi-elliptic springs.

THE DRAWING FIGURES

THE DISCLOSED EMBODIMENT

Figure 1:
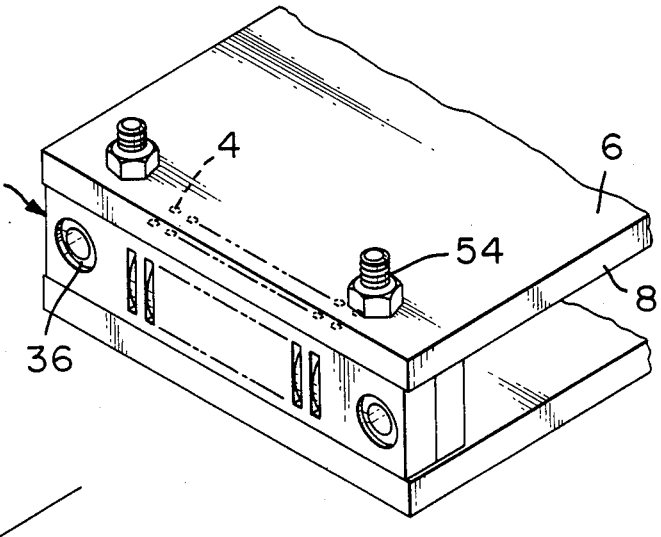
FIG. 1 is a perspective view showing two circuit boards having a connector in accordance with the invention clamped between their opposed surfaces.
Figure 2:
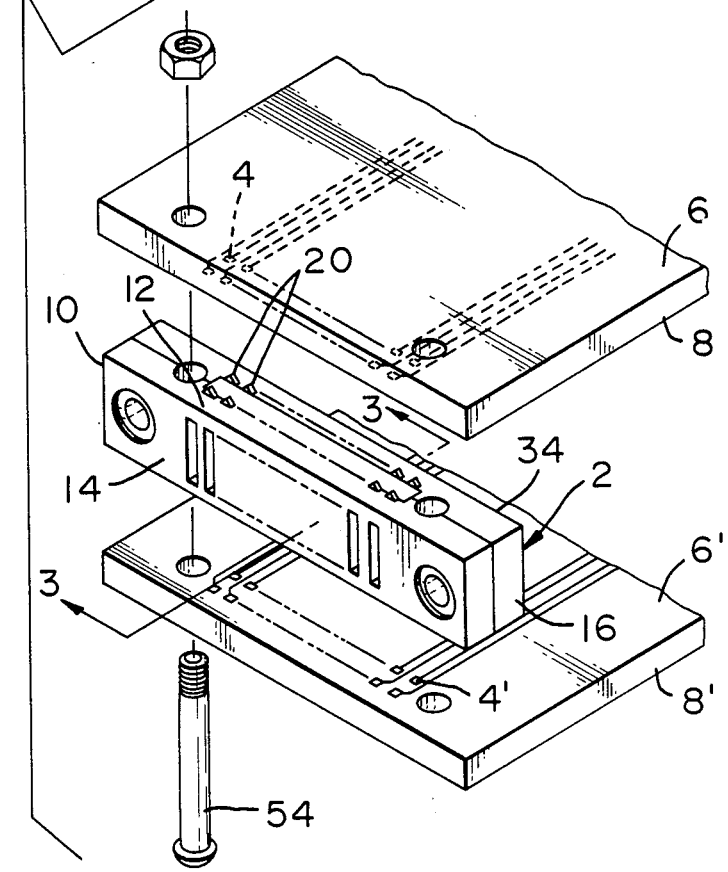
FIG. 2 is a view similar to FIG. 1 but showing the circuit boards exploded from the mating surfaces of the connector body.

A connector 2, FIGS. 1 and 2, in accordance with the invention, serves to connect a first group of electrodes 4 on a first panel surface 6 of a first panel member 8 to a second group 4' of electrodes on a second surface 6' of a second panel member 8'. The surfaces 6, 6' are opposed to each other with the electrodes arranged in two parallel rows on each surface. The rows and the individual electrodes 4, 4' are thus in opposed aligned relationship. In the embodiment shown in FIGS. 1 and 2, the electrodes are terminal pads.

The connector 2 comprises a connector body 10 in the form of a rigid housing assembly having an upwardly facing first connector mating surface 12 and a downwardly facing second connector mating surface 12'. The housing assembly has oppositely facing connector side surfaces 14 and oppositely facing end surfaces 16. The housing assembly contains a plurality of stamped and formed sheet metal conductors 18 which are arranged in two parallel rows with the spacing between the rows and between the individual conductors 18 being the same as the spacing of the terminal pads and the rows of terminal pads.

Figure 4:
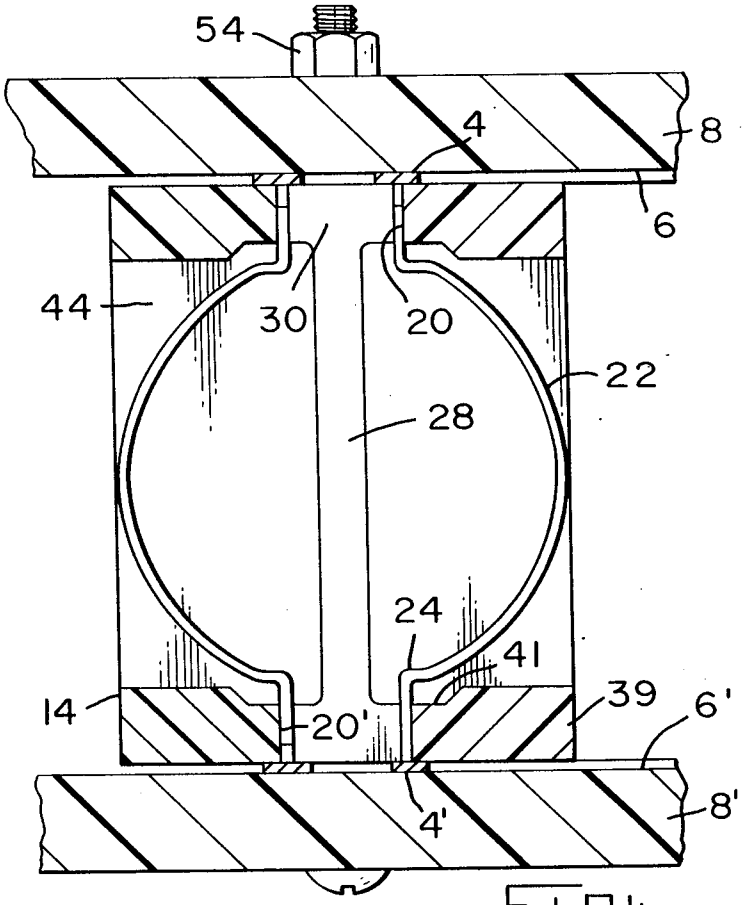
FIG. 4 is a view similar to FIG. 3 but showing the circuit boards assembled to the connector so that the conductors in the connector are in contact with the terminal pads on the circuit boards.

Each conductor has a first end portion 20 which extends normally of, and projects above, the first mating surface 12 and a second end portion 20' which similarly projects beyond the lower connector mating surface 12'. Each conductor further has an intermediate spring portion 22 which is formed as a semi-elliptic spring in the embodiment shown and which is connected to the end portions 20, 20' by short transition sections 24 which extend horizontally as viewed in FIG. 4. The end portions 20, 20' are recessively movable into the housing assembly with accompanying flexure of the spring portion 22 as shown in FIG. 4.

The housing assembly is preferably produced by injection molding and is of a rigid plastic material such as a suitable nylon composition filled with glass fibers to impart rigidity. The housing assembly comprises a generally I-shaped central support or spacer 26 and two side sections 32 which are positioned against the spacer on each side thereof. The central support or spacer 26 comprises a vertically extending web 28 and ends 30, 30' which form portions of the first and second mating surfaces 12, 12'.

Figure 3:
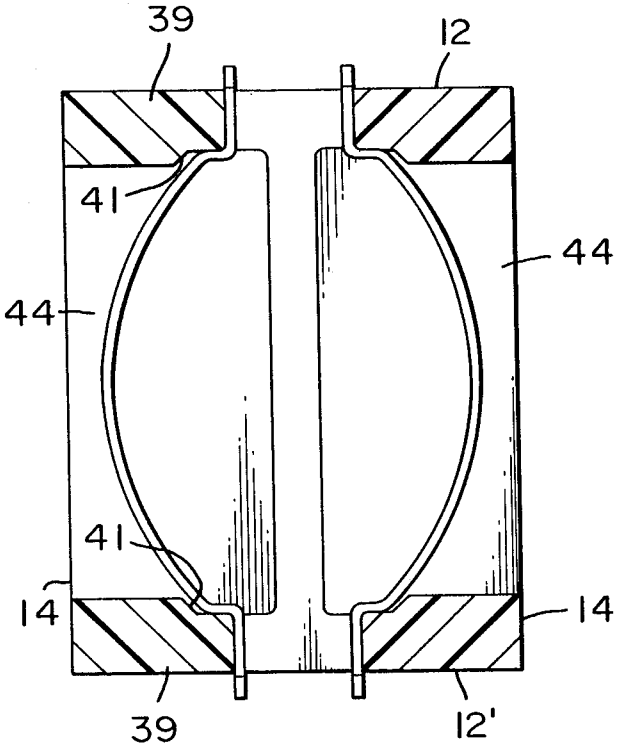
FIG. 3 is a cross-sectional view looking in the direction of the arrows 3—3 of FIG. 2.

The side sections 32 form the connector side surfaces 14 and the end surfaces 16 and have end portions 34 which extend beyond the central support 26. These end portions are secured to each other by permanent fasteners 36 so that the central support is clamped between the side sections. The two side sections are identical to each other and have marginal portions 39 which are adjacent to the first and second mating surfaces 12, 12' and recesses 40 are provided in the side sections for the enlarged ends 30, 30' of the support 26. Also, shallow grooves 42 are provided in the recesses 40 so that the end portions 20, 20' of the conductors will extend slidably through these grooves. As shown in FIGS. 3 and 4, the side-by-side cavities 44 for the intermediate spring portions 22 of the conductors extend inwardly from the side surfaces of the housing assembly and the cavities are contoured adjacent to the marginal portions 39 as shown at 41, FIG. 3, to provide clearance for the transition sections 24 of the conductors. The transition sections 24 and the recessed sections 41 of the cavities ensure that the end portions 20, 20' will be moved into the housing assembly as demonstrated by FIGS. 3 and 4, without becoming jammed.

Figure 5:
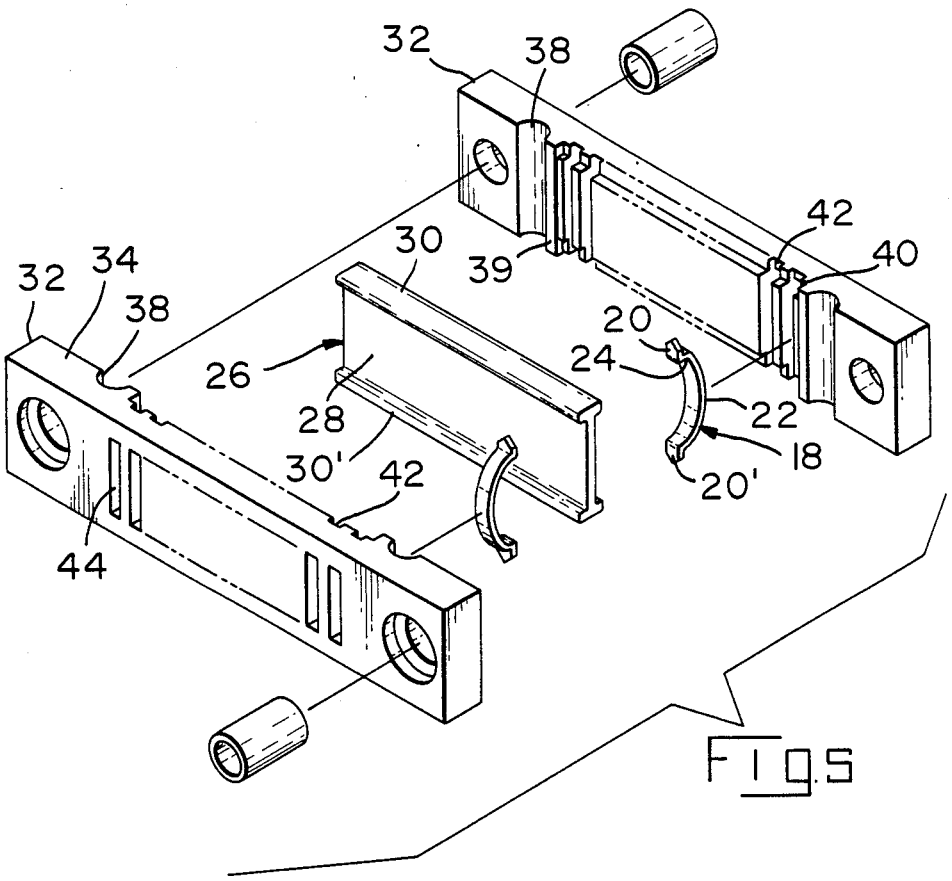
FIG. 5 is a perspective view of the connector with the parts exploded from each other.

Semi-cylindrical recesses 38 extend downwardly as viewed in FIG. 5 through the end portions 34 of the side sections and these recesses define circular openings for fasteners 54 by means of which the panel members 8, 8' are secured to each other with the connector clamped between their opposed surfaces. The connector is assembled to the panel members as shown by FIGS. 1 and 2. The connector is positioned between the opposed surfaces with the end portions 20, 20' in alignment with the conductor pads and the two panel members are secured to each other by the fasteners 54. The panel members will be clamped against the opposed surfaces 12, 12' and the spring portions 22 of the individual conductors will be flexed so that the pointed ends of the conductors are urged into the terminal pads 4, 4'.

Figure 9:
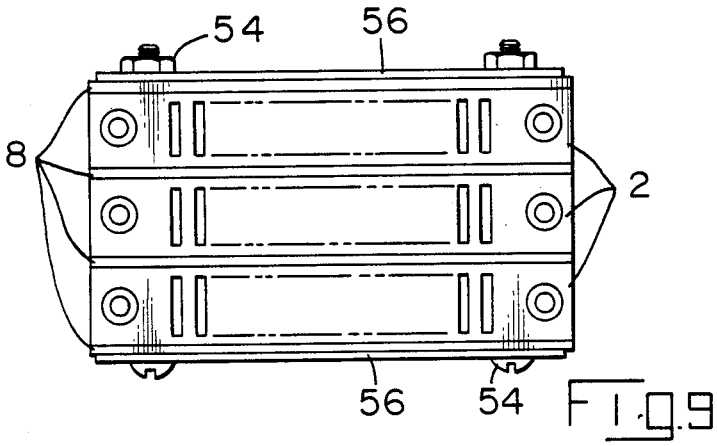
FIG. 9 shows the manner of using the connector with three or more circuit boards.

As shown in FIG. 9, the connector can be used with three or more panel members and if required, steel reinforcing strips 56 can be used to prevent bowing of the panel members. As noted previously, the invention is useful where a high contact force is needed and under some circumstances, the force imposed on the panel members by the end portions of the conductors may cause some tendency for the panel members to bow midway between the ends of the connector.

Figure 6:
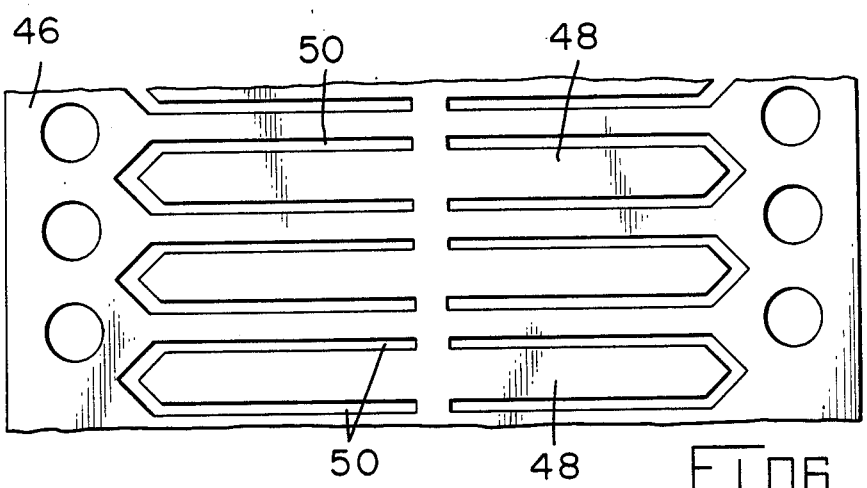
FIG. 6 is a plan view of a strip of conductor blanks prior to forming of the individual blanks.
Figure 7:
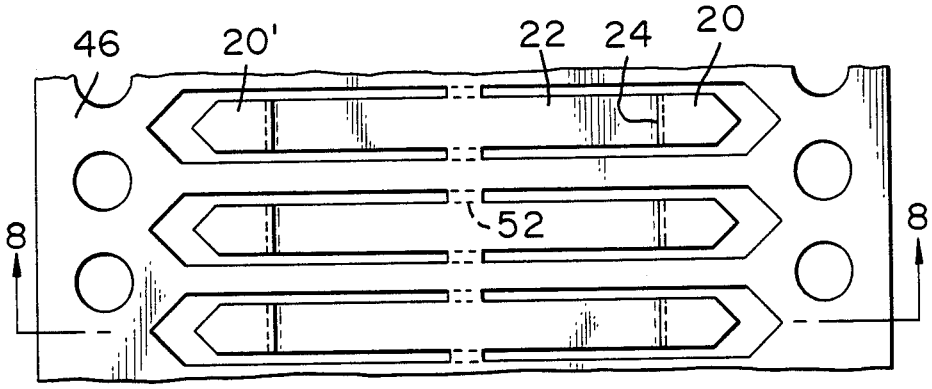
FIG. 7 is a view similar to FIG. 6 but showing the strip after the blanks have been formed to their final configuration.
Figure 8:
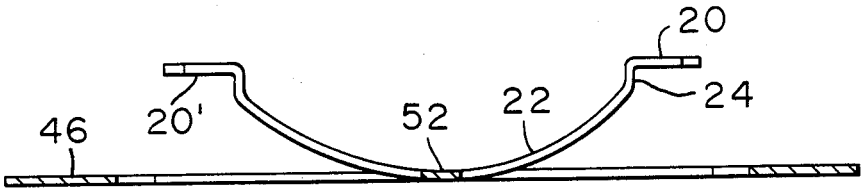
FIG. 8 is a view looking in the direction of the arrows 8—8 of FIG. 7.

The conductors are produced by stamping conductor blanks from continuous strip 46 as shown in FIG. 6, each blank 48 for a conductor being defined by the openings 50 in the strip which are produced by the blanking operation. The individual conductors are then formed in a progressive die as shown in FIGS. 7 and 8 so that the end portions are moved out of the plane of the strip 46. The conductors can be plated while in strip form and the plating metal will be deposited on the pointed ends of the conductors so that electrical contact is established between plated portions of the conductors and the plated terminal pads on the panels. At the time of assembly of the individual conductors to the side sections 32, the conductors are sheared along the shear lines 52, FIG. 7, and moved into the grooves 42. The side sections, with the conductors assembled thereto are then secured to each other with the spacer member positioned between the side sections as shown in FIG. 2.

Under some circumstances, it may be desirable to have one of the end portions 20 or 20' formed as a post for permanent mounting in one of the panel members or as a surface mounting section for soldering to one of the panel members. Under such circumstances, only the remaining end portion would be recessively movable into the housing assembly.

Connectors in accordance with the invention can be designed to satisfy a wide variety of particular requirements. As noted previously, the conductors can be dimensioned, and the material chosen, to produce a relatively high contact force, in the range of 150–200 grams, and the contact force will be maintained by the resiliently deformed spring portion of each terminal. If lower forces are desired, the material of the conductors and their dimensions can be changed to produce such lower contact forces with a high degree of predictability.

I claim:

1. An electrical connector for connecting a first group of electrodes on a first panel surface to a second group of electrodes on a second panel surface, the first and second panel surfaces being opposed to each other and being on parallel spaced-apart panel-like members, the elctrodes in the first group being arranged in a row on the first panel surface, the electrodes in the second group being arranged in a row on the second panel surface, the rows and the individual electrodes being in opposed aligned relationship, the connector having a connector body having oppositely facing first and second connector mating surfaces and having conductors extending through the body and between the first and second connector mating surfaces, the connector being characterized in that:

each of the conductors has a first end portion and a second end portion, the first end portion being proximate to, and extending beyond, the first connector mating surface, the second end portion being proximate to, and extending beyond, the second connector mating surface, each of the conductors has an intermediate resiliently deformable spring portion which extends from the first end portion to the second end portion, at least one of the end portions being recessively movable towards, and into, its associated connector mating surfaces with accompanying resilient deformation of the spring portion, the intermediate resiliently deformable spring portion is configured to provide an electrically conductive path, through which the electrical signals pass between the electrodes in the first group and the electrodes in the second group, each intermediate resiliently deformable spring portion is connected to respective first and second end portions by short transition sections, the short transition sections extend in a plane essentially parallel to the first and the second surfaces, the short transition sections cooperate with respective channels of the connector body when the intermediate resiliently deformable spring portion is in a first, preloaded position, the short transition sections being movable out of the channels as the intermediate resiliently deformable spring portion is moved to a second, deformed position;

the connector body comprises a rigid insulating housing assembly having side-by-side spaced-apart cavities therein which are between the first and second mating surfaces, the spring portions being maintained in the cavities by the cooperation of the first end portion and the second end portion with respective walls of the connector body, such that the entire intermediate resiliently deformable spring portion can be deformed in a plane essentially normal to the first and second panel surfaces, whereby upon placement of the connector body between the first and second panel-like members with the connector body extending parallel to the rows of electrodes, with the first and second connector mating surfaces opposed to the first and second panel surfaces respectively, and with each individual conductor extending between two opposed electrodes, and upon securing the first and second panel-like members to each other so that the connector is clamped between the first and second panel surfaces, the first and second end portions of each conductor will contact an opposed pair of electrodes in the first and second panel surfaces and the spring portion of each terminal will be resiliently deformed thereby to maintain at least one end portion of each conductor in electrical contact with its associated electrode.

2. An electrical connector as set forth in claim 1 characterized in that the electrodes in the first group and the electrodes in the second group are terminal pads on the first and second panel surfaces respectively.

3. An electrical connector as set forth in claim 2 characterized in that the first and second end portions of each of the conductors are recessively movable towards, and into, their associated mating surfaces.

4. An electrical connector as set forth in claim 3 characterized in that each of the conductors is a stamped and formed one piece sheet metal conductor.

5. An electrical connector for connecting a first group of terminal pads on a first panel surface to a second group of terminal pads on a second pane surface, the first and second panel surfaces being opposed to each other and being on parallel spaced-apart panel-like members, the terminal pads in the first group being arranged in a row on the first panel surface, the terminal pads in the second group being arranged in a row on the second panel surface, the rows and the individual terminal pads being in opposed aligned relationship, the connector having a connector body having oppositely facing first and second connector mating surfaces and having conductors extending through the body and between the first and second connector mating surfaces, the connector being characterized in that:

each of the conductors has a first end portion and a second end portion, the first end portion being proximate to, and extending beyond, the first connector mating surface, the second end portion being proximate to, and extending beyond, the second connector mating surface, each of the conductors having an intermediate resiliently deformable spring portion which extends from the first end portion to the second end portion, the first and second end portions being recessively movable towards, and into, the first and second connector mating surfaces respectively with accompanying resilient deformation of the spring portion, the intermediate resiliently deformable spring portion configured to provide an electrically conductive path, through which the electrical signals pass between the electrodes in the first group and the electrodes in the second group, each intermediate resiliently deformable spring portion is connected to respective first and second end portions by short transition sections, the short transition sections extend in a plane essentially parallel to the first and the second surfaces, the short transition sections cooperate with respective channels of the connector body when the intermediate resiliently deformable spring portion is in a first, preloaded position, the short transition sections being movable out of the channels as the intermediate resiliently deformable spring portion is moved to a second, deformed position, the connector body comprises a rigid insulating housing assembly having side-by-side spaced-apart cavities therein which are between the first and second mating surfaces, the spring portions being resiliently maintained in the cavities by the cooperation of the first end portion and the second end portion with respective walls of the connector body, such that the entire intermediate resiliently deformable spring portion can be deformed in a plane essentially normal to the first and second panel surfaces, whereby, upon placement of the connector body between the first and second panel-like members with the connector body extending parallel to the rows of terminal pads, with the first and second connector mating surfaces opposed to the first and second panel surfaces respectively, and with each individual conductor extending between two opposed terminal pads, and upon securing the first and second end portions of each conductor will contact an opposed pair of terminal pads on the first and second panel surfaces, the spring portion of each terminal will be resiliently deformed, the first and second end portions will be urged against their associated terminal pads.

6. An electrical connector as set forth in claim 5 characterized in that the housing assembly has oppositely facing side surfaces which extend normally of the connector mating surfaces, the cavities extending inwardly from at least one of the side surfaces.

7. An electrical connector as set forth in claim 6 characterized in that each of the conductors is of stamped and formed sheet metal, the spring portions of the conductors being formed as semi-elliptic springs.

8. An electrical connector as set forth in any one of claims 5, 6 or 7 characterized in that the housing assembly comprises a support member and a cover which extends beside the support member, the cavities being in the cover, the first and second end portions of the conductors being slidably contained between the cover and the support member.

9. An electrical connector for connecting a first group of terminal pads on a first panel surface to a second group of terminal pads on a second panel surface, the first and second panel surfaces being opposed to each other and being on parallel spaced-apart panel-like members, the terminal pads in the first group being arranged in two parallel rows on the second panel surface, the rows and the individual terminal pads being in opposed aligned relationship, the connector having a connector body having oppositely facing first and second connector mating surfaces and having conductors extending through the body and between the first and second connector mating surfaces, the conductors being arranged in two parallel conductor rows, the connector being characterized in that:

each of the conductors has a first end portion and a second end portion, the first end portion being proximate to, and extending beyond, the first connector mating surface, the second end portion being proximate to, and extending beyond, the second connector mating surface, each of the conductors having an intermediate resiliently deformable spring portion which extends from the first end portion to the second end portion, the first and second end portions being recessively movable towards, and into. the first and second connector mating surfaces respectively with accompanying resilient deformation of the spring portion, the intermediate resiliently deformable spring portion configured to provide an electrically conductive path, through which the electrical signals pass between the electrodes in the first group and the electrodes in the second group, the connector body comprises a rigid insulating housing assembly having side-by-side spaced-apart cavities therein which are between the first and second mating surfaces, the spring portions being maintained in the cavities by the cooperation of the first end portion and the second end portion with respective walls of the connector body, such that the entire intermediate resiliently deformable spring portion can be deformed in a plane essentially normal to the first and second panel surface, each intermediate resiliently deformable spring portion is connected to respective first and second end portions by short transition sections, the short transition sections extend in a plane essentially parallel to the first and the second connector mating surfaces, the short transition sections cooperate with the connector body when the intermediate resiliently deformable spring portion is in a first, preloaded position, the short transition sections being movable out of the channels as the intermediate resiliently deformable spring portion is moved to a second, preloaded position, whereby upon placement of the connector body between the first and second panel-like members with the connector body extending parallel to the rows of terminal pads, with the first and second connector mating surfaces opposed to the first and second panel surfaces respectively, and with each individual conductor extending between two opposed terminal pads, and upon securing the first and second panel-like members to each other so that the connector is clamped between the first and second panel surfaces, the first and second end portions of each conductor will contact an opposed pair of terminal pads on the first and second panel surfaces, the spring portion of each terminal will be resiliently deformed, and the first and second end portions will be urged against their associated terminal pads.

10. An electrical connector as set forth in claim 9 characterized in that the housing assembly has oppositely facing side surfaces which extend normally of the connector mating surfaces, the cavities extending inwardly from the side surfaces.

11. An electrical connector as set forth in claim 10 characterized in that passageways extend from each of the cavities to the first and second connector mating surfaces, the end portions of the conductors extending slidably through the passageways.

12. An electrical connector as set forth in claim 9 characterized in that the housing assembly comprises a central support member and a pair of side covers which are against the support member on opposite sides thereof, the support member being between the two conductor rows, the cavities being in the side covers.

13. An electrical connector as set forth in claim 12 characterized in that each of the conductors is of stamped and formed sheet metal, the spring portions of the conductors being formed as semi-elliptic springs.

14. An electrical connector as set forth in claim 13 characterized in that each of the cover members has marginal portions which are adjacent to the first and second connector mating surfaces, the marginal portions being against the central support member, the cavities being between the marginal portions.

15. An electrical connector as set forth in claim 14 characterized in that passageways extend from the cavities through the marginal portions of the cover members to the first and second connector mating surfaces, the first and second end portions of the conductors extending slidably through the passageways.

* * * * *